US005499663A

United States Patent [19]

Barbeau et al.

[11] Patent Number: 5,499,663

[45] **Date of Patent: * Mar. 19, 1996**

[54] TEXTILE MATERIAL FOR INNER LINING OF FIREFIGHTER PROTECTIVE GARMENT

[75] Inventors: Claude Barbeau, St. Lambert; Ross Cochran, Mount Royal, both of Canada

[73] Assignee: Marcanada Inc., Montreal, Canada

[ * ] Notice: The portion of the term of this patent subsequent to Jun. 28, 2011, has been disclaimed.

[21] Appl. No.: 214,571

[22] Filed: Mar. 18, 1994

Related U.S. Application Data

[63] Continuation-in-part of Ser. No. 31,111, Mar. 12, 1993, Pat. No. 5,323,815.

[51] Int. Cl.[6] ..... A41D 1/02; A41D 13/00

[52] U.S. Cl. ..... 139/420 A; 2/2; 2/69; 2/81; 2/97

[58] Field of Search ..... 139/420 A; 2/2, 2/69, 81, 161.1, 161.2, 97, 243 A, 243.1

[56] References Cited

U.S. PATENT DOCUMENTS

| | | | |
|---|---|---|---|
| 4,141,082 | 2/1979 | Nakazawa et al. | 2/93 |
| 4,287,608 | 9/1981 | Meyer | 139/420 R |
| 4,662,006 | 5/1987 | Ross, Jr. | 2/161 R |
| 5,131,097 | 7/1992 | Grilliot et al. | 2/69 |
| 5,136,723 | 8/1992 | Aldridge et al. | 2/81 |
| 5,189,737 | 3/1993 | Ribicic | 2/97 |
| 5,198,280 | 3/1993 | Harpell et al. | 428/102 |
| 5,202,086 | 4/1993 | Baliga et al. | 2/243 A |
| 5,299,602 | 4/1994 | Barbeau et al. | 139/420 A |
| 5,323,815 | 6/1994 | Barbeau et al. | 139/420 A |

FOREIGN PATENT DOCUMENTS

| | | | |
|---|---|---|---|
| 1056553 | 6/1979 | Canada | 139/81 |

*Primary Examiner*—Andy Falik
*Attorney, Agent, or Firm*—Swabey Ogilvy Renault

[57] ABSTRACT

The textile material is a woven or knit fabric made of multifilament aramid yarns or yarns made of cellulose fire retardant material. When used in conjunction with a firefighter protective garment, the lining increases wearer comfort, reduces metabolic energy requirements, decreases metabolic heat build-up, and the weight of a fire-protective garment including this textile material.

2 Claims, 2 Drawing Sheets

TEXTILE MATERIAL FOR INNER LINING OF FIREFIGHTER PROTECTIVE GARMENT

CROSS-REFERENCE

This application is a continuation-in-part of application Ser. No. 08/031,111 filed Mar.12, 1993 U.S. Pat. No. 5,323,815.

BACKGROUND OF THE INVENTION (a) Field of the Invention

This invention relates to a textile material for use as the inner lining of a fire-protective garment. Wherein the inner lining material increases wearer comfort and mobility, reduces metabolic energy requirements and decreases metabolic heat build-up as well as reducing weight and overcoming the problem of decreasing mechanical resistance as fabric weight decreases. More particularly, the invention is concerned with the material of a firefighter protective garment.

(b) Description of Prior Art

Firefighter protective garments usually consist of three or more discrete layers of fire-resistant materials, The various layer are normally:

1) The outer shell which provides protection against puncture, cuts , flame and heat;
2) the moisture barrier substrate and moisture barrier polymer which, although fire-resistant, have as their principal purpose protection against water penetration (in certain cases they are permeable to perspiration vapor to increase wearer comfort);
3) the thermal barrier insulation whose principal function is to provide protection against heat transfer; and
4) the inner lining or face cloth (which is normally quilted to the thermal barrier insulation) which protects the thermal barrier from wear from the inside of the garment, and provides a last layer of heat and flame protection.

All fabrics used in the construction of firefighter's protective clothing must pass minimum performance requirements for flame, heat and tear resistance, as well as for thermal protection in the ensemble. The inner lining is most often constructed of spun aramid yarns. These spun yarn fabrics do not slide easily on themselves or on surfaces inside or outside the garment (e.g. pants, shirt, skin, or boots) with which they come into contact. The resistance of spun yarn fabrics to sliding is further exacerbated by the fact that these inner lining fabrics are most often of a ripstop weave construction. As a result, a certain amount of body energy is required to move in the garments, flex joints and to otherwise perform functions associated with the job of the wearer. Even donning and doffing of the garment can be arduous because of the difficulty of inserting a shirt arm or a leg already in a pant leg, into the garment.

One of the leading causes of firefighter injury and mortality is stress. Stress may be caused by metabolic heat build-up and retention which in turn may be partly caused by the weight of the garment, the insulation properties of the garment, or the impediments to movement that the garment may present.

Even if circumstances are not severe enough to make heat stress a threat, wearer comfort is decreased as the garment becomes heavier and more constricting. In addressing any of the causes of heat stress, care must be taken not to fall below the minimum performance requirements of the various national standards. For example, a garment could be made lighter by simply employing lighter weight fabrics, however, as fabric weight drops, so does the fabric's mechanical resistance and insulating value.

In the design of an inner lining, care must be taken not to fall below the minimum performance requirements of the various national standards. For example, a garment could be made lighter by simply employing lighter weight outer shell fabrics, however, as fabric weight drops, so does the fabric's mechanical resistance. As a result inner lining fabrics of firefighter garments do not weigh less than 3.0–3.3 ounces per square yard. In addition, these inner lining fabrics are most often of a ripstop (a.k.a. pajama check) weave construction so as to meet the tear resistance requirements of the various national standards.

One method for overcoming the decrease in mechanical resistance as fabric weight decreases is to use filament instead of spun yarns, the former having very high tensile and abrasion strength. Similarly, filament yarns are more slippery than spun yarns thereby reducing friction between the filament fabric and any other fabric with which they may come in contact. This slipperiness increases the flexibility and mobility of the garment thereby reducing metabolic heat build-up.

The use of spun aramid yarns in a ripstop weave construction renders the inner lining textile material susceptible to pilling. This pilling is not only esthetically unpleasing but may also increase the resistance to movement of the garment.

U.S. Pat. No. 4,583,247 describes a heat insulating garment made of a composite interlining sheet of porous material having low heat conductivity and high resilience. A layer of flexible reflective material is bonded to the outside of the porous material.

U.S. Pat. No. 4,897,886 describes a firefighter's garment having an outer layer, an intermediate layer, and an inner layer. Spacer elements are disposed between two of the layers of the garment to provide air spaces between layers of the garment. This design seeks to enhance thermal protective performance without significantly increasing garment weight. Its primary objectives are not:

-reduction in garment weight

-nor enhanced mobility

-nor equal or superior heat and mechanical resistance at lower fabric weights.

U.S. Pat. No. 4,922,552 describes a design which seeks to increase flexibility at certain places in the garment by reducing the fabric thickness in these specific areas. Coincidentally, this would provide a very small reduction in garment weight.

U.S. Pat. No. 5,136,723 discloses a firefighter garment including an outer shell, a moisture barrier within the shell and an inner thermal barrier. The outer shell may be made of NOMEX® or KEVLAR® fibers. The moisture barrier may be made of NOMEX® fibers and the thermal barrier may have a face cloth of NOMEX® or KEVLAR®. The aim of this Patent is the promotion of moisture vapor (perspiration) transmission from the inside to the outside of the garment without sacrificing thermal protective performance.

It is a feature of the present invention to provide a textile material for the inner lining of a firefighter garment that increases wearer comfort, reduces metabolic energy requirements and decreases metabolic heat build-up.

It is another feature of the present invention to reduce the overall weight of the inner lining and hence the firefighter garment without compromising the mechanical resistance of the inner lining while also maintaining the required mechanical and thermal characteristics.

It is another feature of the present invention to provide an inner lining for firefighter garments that reduces the coefficients of static and sliding friction between the layers of the garment and between the garment and other interior or exterior surfaces which it may contact.

It is another feature of the present invention to provide an inner lining for firefighter protective garments that is less susceptible to pilling.

DISCLOSURE OF INVENTION

These and other features of the present invention may be achieved by providing a textile material to constitute an inner lining fabric for firefighter protective garments, the textile material consisting of a weave including warp and weft yarns or a knitting of yarns, the warp and weft yarns and the yarns used in the knitting being multifilamentary aramid, polyamide or polybenzimidazole yarns, or yarns made of cellulose fire retardant material, the yarns providing a slippery inner surface thereby reducing restriction to movement by a wearer and permitting easier and quicker donning and doffing of the garment.

In order to obtain a more supple and flexible textile material, the inner lining fabric weight is less than 3.0 ounces per square yard.

In order to increase the slipperiness and to reduce pilling of the textile material, the weave is a plain weave.

BRIEF DESCRIPTION OF DRAWINGS

The invention is illustrated but is not restricted by the annexed drawing of a preferred embodiment, in which.

DESCRIPTION OF PREFERRED EMBODIMENT

Figure 1:
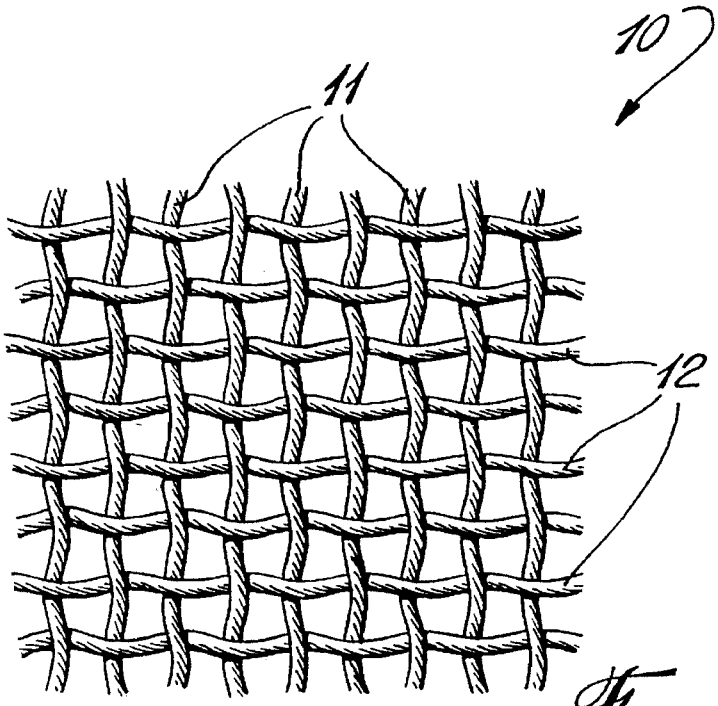
FIG. 1 is an illustration on an enlarged scale of a textile material consisting of a weave for the inner lining of fire-protective garment.
Figure 2:
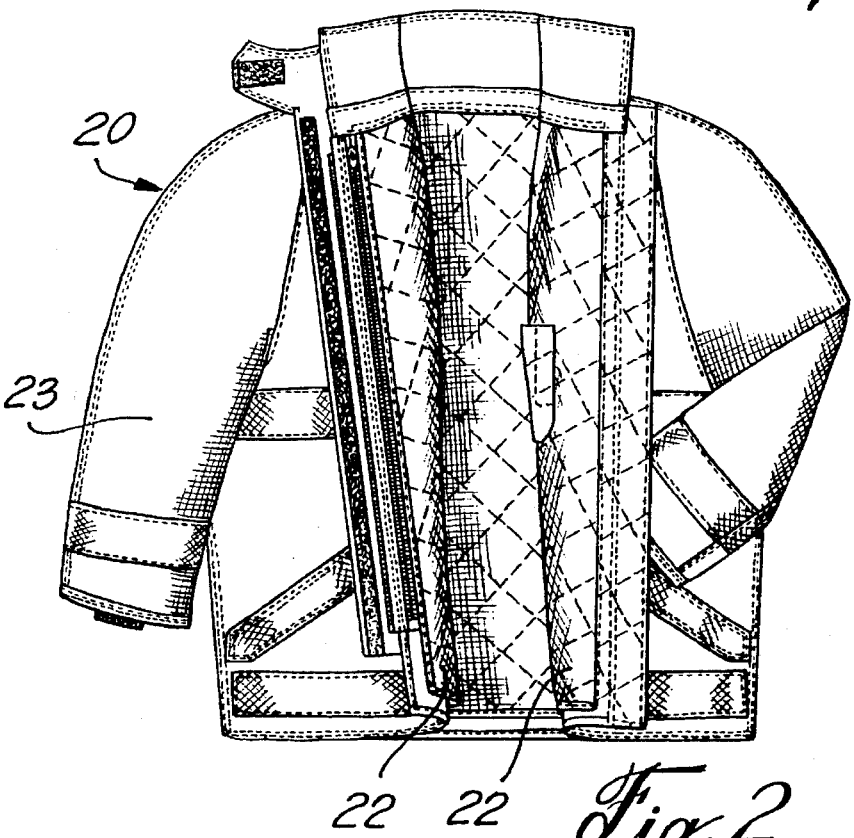
FIG. 2 is a perspective view of a firefighter garment having an inner lining constructed with a fabric of the present invention.

Referring to the drawings, it will be seen that the inner lining is formed with the textile material 10 which is a weave which includes an arrangement of warps 11 and wefts 12 formed of aramid yards. In the drawing identical multifilament aramid yarns are used in both the warp and weft direction. The weave of the fabric is a plain weave.

The invention, however, does not preclude the use of differing or alternating multifilament aramid yarns in either the warp or weft directions.

Figure 3:
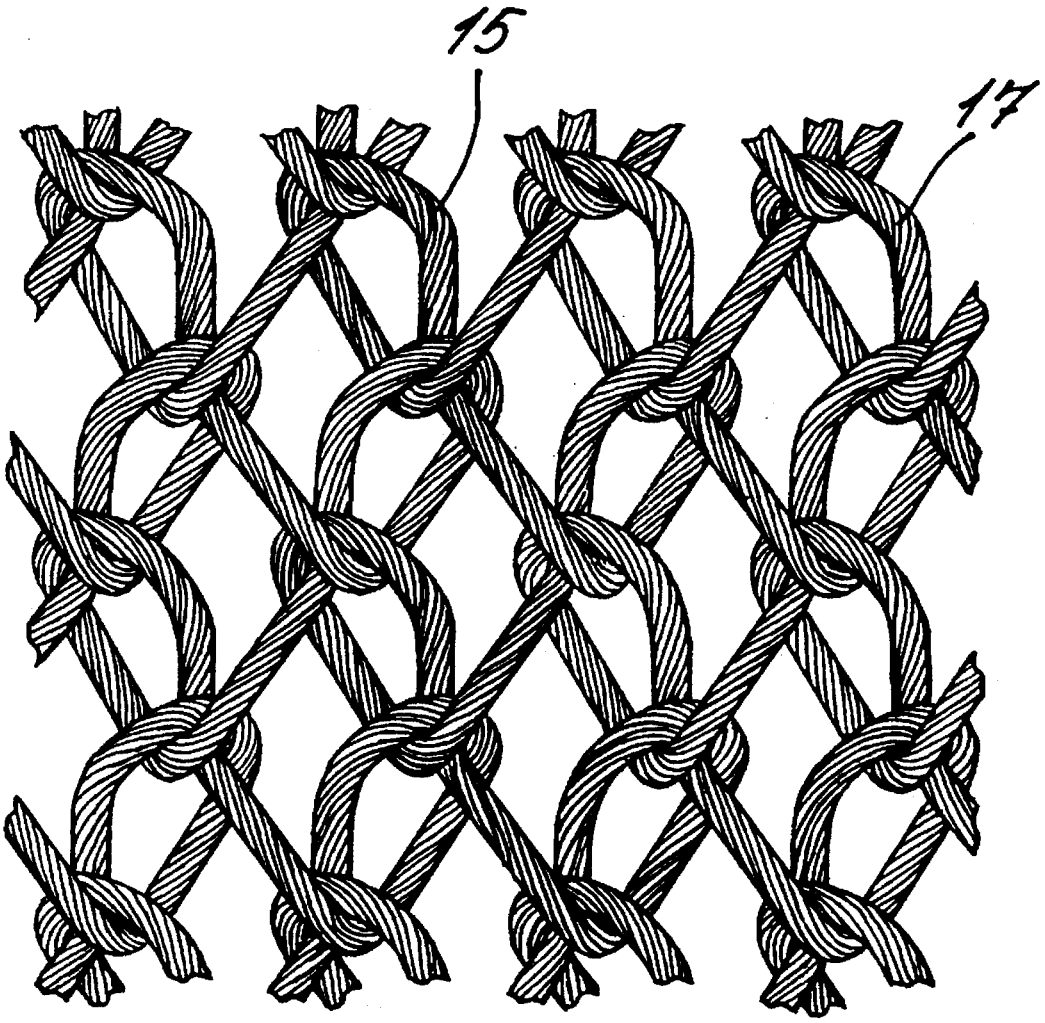
FIG. 3 is an illustration on an enlarged scale of a textile material consisting of a knitting for the inner lining of a fire protective garment according to the invention.

Furthermore, although the drawing shows a plain weave constructions, the invention encompasses other weave constructions such as basket weaves, poplins, twills, herringbones, etc. The invention also encompasses a knitting made of the above yarns, as shown in FIG. 3. This aramid fabric was conceived particularly, but not exclusively, for use as an inner lining in the construction of fire-protective garments, such as a firefighter's garment. Normally, but not necessarily, the inner lining fabric is quilted in a known manner to an inner surface of a thermal barrier insulation in a fire-resistant garment.

It is also understood that other yarns of the polyamide, aramid, polyimide, or polybenzimidazole families may also be used, as well as yarns made of a cellulose fire retardant material, without departing from the scope and spirit of the present invention.

We claim:

1. In combination, a firefighter garment and an inner lining therefor, said inner lining comprising a textile material being selected from the group consisting of at least one of a weave comprising a warp and weft arrangement of yarns and a knitting made of yarns having similar characteristics, said warp and weft arrangement of yarns and said knitting of yarns being multifilamentary aramid, polyimide, polyamide, or polybenzimidazole yarns, or multifilamentary yarns made of cellulose fire retardant material, the yarns providing a slippery inner surface thereby reducing restriction to movement by a wearer and permitting easier and quicker donning and doffing of the garment.

2. The combination according to claim 1 wherein said weave is a plain weave.

* * * * *